US007203983B1

(12) United States Patent
Reeves et al.

(10) Patent No.: US 7,203,983 B1
(45) Date of Patent: Apr. 17, 2007

(54) PILLOW

(75) Inventors: Brian Reeves, Ladera Ranch, CA (US); Martin Geoffreys, San Juan Capistrano, CA (US)

(73) Assignee: AQSIS Corporation, Lake Forest, CA (US)

( * ) Notice: Subject to any disclaimer, the term of this patent is extended or adjusted under 35 U.S.C. 154(b) by 0 days.

(21) Appl. No.: 11/388,465

(22) Filed: Mar. 24, 2006

Related U.S. Application Data

(60) Provisional application No. 60/664,929, filed on Mar. 25, 2005.

(51) Int. Cl.
*A47G 9/10* (2006.01)
*A47C 20/00* (2006.01)

(52) U.S. Cl. ..... 5/636; 5/645; 5/639

(58) Field of Classification Search ..... 5/636–645
See application file for complete search history.

(56) References Cited

U.S. PATENT DOCUMENTS

| | | | | |
|---|---|---|---|---|
| 1,385,355 | A | 7/1921 | Banks | |
| 2,896,227 | A | 7/1959 | Reed | |
| 2,940,088 | A | 6/1960 | Boos | |
| 3,243,828 | A | 4/1966 | McCarthy | |
| 3,521,310 | A | 7/1970 | Greenwalt | |
| 3,648,308 | A | 3/1972 | Greenwalt | |
| 3,757,365 | A | 9/1973 | Kretchmer | |
| 4,218,792 | A | 8/1980 | Kogan | |
| 4,424,599 | A | 1/1984 | Hannouche | |
| 4,494,261 | A | 1/1985 | Marrow | |
| 4,821,355 | A * | 4/1989 | Burkhardt | 5/636 |
| 4,832,007 | A * | 5/1989 | Davis et al. | 250/580 |
| 4,916,765 | A * | 4/1990 | Castronovo, Jr. | 5/640 |
| 5,123,132 | A * | 6/1992 | Dixon | 5/636 |
| 5,457,832 | A | 10/1995 | Tatum | |
| D370,819 | S | 6/1996 | Bonaddio | |
| 5,638,564 | A | 6/1997 | Greenawalt | |
| 5,689,844 | A * | 11/1997 | Liu | 5/636 |
| 5,708,998 | A | 1/1998 | Torbik | |
| 5,727,267 | A | 3/1998 | Keilhauer | |
| 5,926,879 | A * | 7/1999 | Davis | 5/636 |
| 6,079,066 | A | 6/2000 | Backlund | |
| 6,182,312 | B1 | 2/2001 | Walpin | |
| 6,345,401 | B1 | 2/2002 | Frydman | |
| 6,381,784 | B1 * | 5/2002 | Davis et al. | 5/636 |
| 6,401,279 | B1 | 6/2002 | Vaughn | |
| 6,471,726 | B2 | 10/2002 | Wang | |
| 6,513,179 | B1 * | 2/2003 | Pan | 5/636 |
| 6,574,809 | B1 | 6/2003 | Rathbun | |
| 6,629,324 | B1 | 10/2003 | Shapiro | |
| 6,668,404 | B2 | 12/2003 | Lanteri | |

(Continued)

*Primary Examiner*—Michael Trettel
(74) *Attorney, Agent, or Firm*—Mind Law Firm; Jeromye V. Sartain

(57) ABSTRACT

A pillow apparatus comprising at least one roll portion, a bottom layer extending horizontally from the roll portion, a top layer extending horizontally from the roll portion substantially adjacent to the bottom layer, and a hollow core formed between the bottom layer and the top layer substantially centered within the pillow so as to form a central back-sleeping region and opposite, adjacent side-sleeping regions. It is emphasized that this abstract is provided to comply with the rules requiring an abstract so as to allow a searcher to quickly determine the subject matter. It is presented with the understanding that it will not be used to interpret or limit the scope and meaning of the claims.

21 Claims, 5 Drawing Sheets

U.S. PATENT DOCUMENTS 6,671,906 B1 1/2004 Milligan
6,704,958 B2 3/2004 Gohl
6,742,207 B1 6/2004 Brown
6,763,538 B1 7/2004 Tsai
6,817,049 B1 11/2004 Hall
6,823,546 B1 11/2004 Hsu
6,981,288 B1 * 1/2006 Hu ..... 5/636

* cited by examiner

PILLOW

RELATED APPLICATIONS

This application claims priority and is entitled to the filing date of U.S. Provisional application Ser. No. 60/664,929 filed Mar. 25, 2005, and entitled "Lordotic Pillow." The contents of the aforementioned application are incorporated by reference herein.

INCORPORATION BY REFERENCE

Applicants hereby incorporate herein by reference any and all U.S. patents and U.S. patent applications cited or referred to in this application.

BACKGROUND OF THE INVENTION

1. Field of the Invention

Aspects of this invention relate generally to a pillow, and more particularly to an orthopedic pillow designed to support the neck in a physiologically neutral spinal position.

2. Description of Related Art

The following art defines the present state of this field:

U.S. Pat. No. 1,385,355 to Banks is directed to an improvement in pillows or the like consisting of a middle compartment and two lateral compartments for the purpose of providing a clinical accessory which is not only hygienic and orthopedic in any of the three (3) usual horizontal positions in which the body may be placed when using the subject pillow, but also capable of allowing the user to enjoy the maximum amount of physical and mental comfort, whether reposing upon the dorsum or upon the right or left side while using the pillow.

U.S. Pat. No. 2,896,227 to Reed is directed to an adjustable, contoured pillow designed for the purpose of accommodating a human being and is particularly adapted to conform to the general configuration of a person's body from the shoulders up by means of inflatable cores.

U.S. Pat. No. 2,940,088 to Boos is directed to a pillow formed on its top surface with head and neck receiving portions and lateral cheek receiving concavities for the purpose of allowing the user, when lying on his back, to be in a position which affords maximum relaxation while also accommodating the user's cheeks when sleeping on his side.

U.S. Pat. No. 3,243,828 to McCarthy is directed to a pillow that can be individually tailored to accommodate any given person's orthopedic cervical support requirements whether sleeping on the back or side by providing a single body member within which various inserts may be installed to create a pillow having the desired thickness and resilience.

U.S. Pat. No. 3,521,310 to Greenwalt is directed to a pillow constructed to provide firm support to the neck portion of an individual while providing less firm support to the head portion, the pillow comprising a pair of firm outer members and a less firm intermediate member, the upper and lower surfaces of the intermediate member being coextensive with the upper and lower surfaces of the outer members respectively, the upper and lower surfaces of the outer members tapering laterally away from the intermediate member to form a convexly curved outer edge.

U.S. Pat. No. 3,648,308 to Greenwalt is directed to an elevated traction pillow having, in side view, a substantially triangular configuration. The pillow extends in length from proximate the sacrum to above the head of the user and is comprised of a firm support member and a head-receiving member. The support member comprises all of the triangular configuration except for the apex thereof wherein the head-receiving member is secured. The head-receiving member is comprised of material offering negligible resistance when receiving the head of an individual. In a preferred embodiment, a cervical spine support, i.e., neck support, is formed on the firm support member adjacent the head-receiving member and extends upwardly of the firm support member.

U.S. Pat. No. 3,757,365 to Kretchmer is directed to a pillow configured as a flat substantially rectangular block of material that is more resilient on its upper top layer and is less resilient on its lowermost layer. It is substantially rectangular overall, but has a cutout in at least one of the longer rectangular sides, although this cutout may be repeated in the opposite rectangular side. The cutout is substantially circular, more or less, and is not greater than a semi-circle, although it may be somewhat less than a semi-circle, the cutout serving to receive the sleeper's shoulder with the attached arm extendable beyond the pillow and not subject to any pressure from the pillow, being entirely free thereof, and, of course, free of any pressure from the sleeper's head. The thickness of the pillow is such that the sleeper's head is supported in a horizontal position, with the neck and windpipe free of any bends. As a result, breathing is freer than with a conventional pillow, where the arm often extended under the pillow attempting to hold the head horizontal, in which it often fails, but such does succeed in restricting the blood flow in the arm, leading to a condition strongly resembling bursitis in pain and restriction of arm movement, a painful condition not easily remedied.

U.S. Pat. No. 4,218,792 to Kogan is directed to an orthopedic pillow made of a block of cellular material having the consistence of a latex foam and having, as seen in plan, substantially the shape of a rectangle or a trapezium, the large side or the large base of which is formed with a concave frontal curvature, the top of the block bounding a concavity in the medium portion of the curved edge and said concavity being continued by a recess.

U.S. Pat. No. 4,424,599 to Hannouche is directed to a cervical pillow having a shoulder engaging portion, an occiput engaging portion, and a neck engaging portion therebetween. The cervical pillow provides continuous support from the shoulder portion to the occipital portion of the user.

U.S. Pat. No. 4,494,261 to Marrow is directed to a composite head and neck cushion for use by a person in a supine position. The cushion includes a first, resilient member having an upper surface which conforms to and supports the physiologic curvature of the cervical vertebrae. A second member supports the head in a raised, but unflexed position. The invention may alternatively be described as a method for cushioning the head and neck. The method comprises (1) resiliently supporting the back of the neck of the person in an elevated position while permitting the cervical vertebrae to maintain their normal, physiologic curvature, and (2) supporting the head of the person in an elevated position while maintaining the cervical vertebrae and the occiput in an unflexed, physiologic position.

U.S. Pat. No. 4,832,007 to Davis is directed to a pillow of resilient material having a generally rotatable portion (cervical roll) for supporting the cervical region of a user. With a user's neck received across the pillow cervical roll and the user's head received on the pillow, rotation of the cervical roll in conjunction with collapse of angled chambers defined within the resilient pillow establishes traction in the cervical region of the user. Once its internal chambers are essentially fully collapsed, the pillow provides a generally continuous support medium for optimized resilient support of the user's neck and head, while maintaining a degree of cervical region traction with natural cervical curvature achieved through curved support of the user's cervical region across the cervical roll of the pillow.

U.S. Pat. No. 5,123,132 to Dixon is directed to an anti-snoring pillow which reduces the snoring by the user when sleeping by positioning the head of the user such that the degree of blockage in the user's breathing passageway is reduced. The anti-snoring pillow includes a base member which is preferably inclined and has a curved front edge which is lower in height than the rear edge. The upper surface of the base member adjacent the front edge has an elongated bolster secured thereto, which bolster is curved along its length to conform to the curved shape of the front edge of the base member. The bolster also includes a curved peripheral cross-sectional area for comfortable support of a user's neck. The bolster and the base member, and the choice of materials therefor, act in conjunction to ensure comfort and also the positioning of a user's head so as to decrease the blockage of the user's breathing passageway when the user is in a back or in a side sleeping position.

U.S. Pat. No. 5,457,832 to Tatum is directed to a U-shaped pillow providing for the maximization of the cross-sectional area of the air passage of the user at the level of the oropharynx. The user's head is extended backwards in the supine position with the natural curvature of the neck being supported by a supine neck resting portion and the user's occiput resting directly against the underlying mattress. Additionally the pillow has elevated lateral head and neck resting portions and sloped transitional neck resting portions, all structured so that when a user rolls between the supine and lateral decubitus positions the user's thoracic and cervical spine are maintained substantially aligned.

U.S. Pat. No. D370,819 to Bonaddio is directed to an ornamental design for a neck roll pillow.

U.S. Pat. No. 5,638,564 to Greenwalt is directed to a therapeutic pillow for supporting the head and neck of a person lying in a supine position. The pillow comprises three types of material, each having differing degrees of firmness; a first material having in cross-section a U-shaped form with one end wider than the other end, a second material having a separated pair of end portions of equal width, respectively, with the first material end portions and secured thereto, respectively to form curved ends of the pillow and the third material having a rectangular shape of a size to fit into the open center portion formed by the first and second materials.

U.S. Pat. No. 5,708,998 to Torbik is directed to a pillow providing proper cervical support whether the sleeper is on his back or on his side. Side sections including cutouts on the left and right of the pillow provide clearance for the airways during side sleeping, and a multi-level construction provides the proper head and neck support for either back or side sleeping positions. A high quality fiber is used in rolled and layered sections to provide comfort for the sleeper and resiliency of the pillow over prolonged use. Dual neck rolls of different diameters allow two sleepers of different neck sizes to alternately use the same pillow.

U.S. Pat. No. 5,727,267 to Keilhauer is directed to a therapeutic sleeping pillow for a user that is generally rectangular with longer front and rear edges and a pair of shorter side edges and upper and lower surfaces. A central portion of the upper surface is provided with a cavity for receiving the user's head, with a neck-supporting ridge formed between the front edge of the pillow and the cavity in the central portion. A wedge-shaped extension of the pillow projects from the front edge to support the upper back of the user. At least one of the pair of shorter side edges has an extension disposed thereon. Each such side extension is provided with a relatively shallow central cavity on the upper surface for receiving and supporting the user's head and a front edge for supporting the user's neck. The upper surface of each such side extension slopes generally downwardly from the front edge towards the rear edge.

U.S. Pat. No. 6,079,066 to Backlund is directed to a pillow made of resilient material and including a top side and bottom side which delimit a head section for supporting a user's head. The pillow has at least one elongated neck section adjoined to the head section wherein the upper side of the neck section is higher than the head section. The pillow is also provided with a resilient material having a channel.

U.S. Pat. No. 6,182,312 to Walpin is directed to an orthopedic pillow that comprises several components of varying densities, which in combination provide improved and more immediate comfortable support for the head and neck region, while enhancing the multi-alignment features for the spine, head, and neck of a user in back-lying and side-lying body positions, and do not require the user to endure a break-in period to allow the pillow to conform to the shape of the user's head. The pillow comprises a firm core comprising a first and second lengthwise edge, a top surface, and a bottom surface; a recess located on the top surface of the core; a layer of soft, viscoelastic foam located within the recess; a layer of soft, Dacron fiber located along a top surface of the layer of foam; and a soft, C-shaped layer of viscoelastic foam wrapped around the core, whereby the C-shaped layer of foam covers the first lengthwise edge of the core, the bottom surface of the core, and the second lengthwise edge of the core.

U.S. Pat. No. 6,345,401 to Frydman is directed to an adjustable orthopedic support pillow which includes a contoured top layer, a plurality of supporting layers, each having tongue-and-groove structures to enable the contoured layer to be removably supported by one or more additional supporting layers.

U.S. Pat. No. 6,381,784 to Davis is directed to a pillow having raised ribs which are angled at an acute angle with respect to a bottom surface of the pillow and define the upper surface of the pillow contacted by the user's head and neck. The angled ribs provide traction forces to the head and neck of the user. The ribs vary in thickness in the longitudinal direction along which a person's spine is oriented. The pillow preferably has a rear portion for supporting a person's head and a front portion for supporting a person's neck, and the ribs on the rear portion are upwardly inclined toward the rear edge of the pillow and the ribs on the front portion are upwardly inclined toward the front edge of the pillow, so that traction forces on the head and neck are exerted in opposite directions. The pillow preferably also includes a forward extension portion adapted to support the lower neck and central upper back region between the shoulder blades, the extension portion being substantially narrower than the main body portion and also having the angled ribs.

U.S. Pat. No. 6,401,279 to Vaughn is directed to a neck supporting pillow for maintaining a clear air passage through a user's neck while the user is sleeping. The neck supporting pillow includes a pillow comprising an outer wall having opposed side ends and a concave top side, and further includes an inner wall, an internally-disposed inner chamber, and an internally-disposed outer chamber being separated from the inner chamber with the inner wall and having an upper compartment and a lower compartment being separated by an annular divider; and further includes a plurality of support members which are essentially planar and made of fabric material, each of the support members extending at a slant from the inner wall to a respective side end of the outer wall; and also includes a plurality of valve member disposed in and through the inner wall to control flow of liquid or air between the inner chamber and the outer chamber.

U.S. Pat. No. 6,471,726 to Wang is directed to an ergonomic pillow comprising a body including an inclined surface on either side, an arcuate central recess, and a slope near either side extended from the inclined surface to the recess so that either slope has the highest elevation on a top surface of the body; a front lengthwise projection member having a front slant extended from a bottom of the body adjacent to the recess; first and second cavities on the bottom of the body adjacent to either side and disposed corresponding to either slope; and an elongate third cavity at an underside of the projection member having the same orientation as the projection member. The pillow appropriately support face, ear, spine and shoulder for relaxing head and spine of a user in face-up or side sleeping.

U.S. Pat. No. 6,574,809 to Rathbun is directed to a pillow that supports a person's head while the person sleeps on their side and does not induce any pressure to a person's face. The pillow includes a body which has a first body portion and a second body portion extending from the first body portion. The first body portion is substantially rectangular-shaped and provides a base for the second body portion. The second body portion defines at least one recess and is positioned such that a plurality of recesses extend from the sides of the pillow towards a lower section of the second body portion.

U.S. Pat. No. 6,629,324 to Shapiro is directed to a pillow specifically designed to avoid pressure on the ears, lobes and cartilage and to evenly distribute pressure on the other surfaces of the face. Its top surface is contoured such that the curvature of the head and neck is accommodated. The ears are protected by the presence of recesses in the top surface of the pillow which are shaped similarly to the ear with one generally arcuate side and one generally flat side and positioned somewhat closer to the front edge of the pillow. The recesses are of sufficient size and depth so that as a person lies his head on one side with one ear positioned in a recess, there is no pressure on the ear, its lobe, or cartilage. The pillow is especially effective for reducing the pain of recovery from lobe or cartilage piercings.

U.S. Pat. No. 6,668,404 to Lanteri is directed to a device for maintaining the body, for use as a pillow, that includes at least one surface for supporting the head and a central clearance defining two side surfaces extending the support surface. The pillow has a length not less than the body measurements of an adult user from the lower ribs to the ear, thereby adjusting the pillow support surface on the body in all positions of use.

U.S. Pat. No. 6,671,906 to Milligan is directed to an adjustable pillow having an upper housing comprising a plurality of compartments, a plurality of support elements and a lower housing secured to the upper housing to keep the support elements inside the upper housing is disclosed. The support elements are configured to be positioned within one of the compartments. Each compartment has a height that is adjustable by varying the number of support elements positioned within the compartment. Preferably, the compartments include a neck support compartment, a head support compartment and a pair of side support compartments.

U.S. Pat. No. 6,704,958 to Gohl is directed to a pillow, in particular for use in the context of therapeutic measures, having a pillow body made of an elastically deformable material, in which several loudspeakers can be positioned and which forms a support surface on its upper side, which is characterized in that the loudspeakers are retained in a rail made of an elastically deformable material, and the rail is detachably inserted into a corresponding recess on the underside of the pillow body.

U.S. Pat. No. 6,742,207 to Brown is directed to a contoured pillow including a top, a bottom, a front, a back and opposite sides. The front slopes forwardly from bottom-to-top and changes laterally in depth from side-to-side for cradling and supporting the shoulder. A neck support extension projects upwardly from the top and front and provides enhanced neck support due to the sloping configuration of the front. The top includes a recess forming a face relief pocket, right and left jaw relief areas, right and left airways extending from the jaw relief areas to the sides and a cranial support ridge. The pillow is molded from memory foam with thermally responsive characteristic for shaping itself to a particular user in conjunction with the generally concave geometry designed to give way to a generally spherical facial structure.

U.S. Pat. No. 6,763,538 to Tsai is directed to a pillow that mainly includes two side frames, at least one crosspiece firmly engaged at two outer ends with locating holes provided at two opposite inner sides of the two side frames, and a plurality of round bars extended between the two side frames with respective outer ends rotatably inserted into insertion holes correspondingly spaced along outer edges of the two opposite inner sides of the side frames. With a predetermined clearance existed between any two adjacent insertion holes, the round bars inserted thereinto are adapted to form rotatable and air-pervious supporting surfaces on the pillow.

U.S. Pat. No. 6,817,049 to Hall is directed to a triune, substantially bilaterally symmetrical pillow for a reclining human being is configured to provide therapeutic and support and comfort for the head and neck while lying on one's back and side, and allow use in two, opposite orientations to increase durability and functional capacity. A center section is provided with a thin portion, abutted on either side along one axis by two substantially similar convex portions, and abutted on either side along a second axis normal to the first by two substantially identical flat end sections. The end sections have cutaways near the bottoms of their sides, to either side of their connections to the center section, that are designed to accommodate the shoulder of a human user.

U.S. Pat. No. 6,823,546 to Hsu is directed to an ergonomical massaging pillow comprising a pillow body having at least one side being a cavity and the surface of the pillow body provided with a plurality of extendable slits; and an insertion rod mounted within the cavity and having a plurality of connectable sections with various hardness and softness and the surface of the insertion rod being a plurality of recesses so that a plurality of protrusions are formed on the surface of the insertion rod and the size of the protrusions and the recesses depend greatly on the weight of the spinal cord of the user. When the pillow is used, the protrusions and the slot will be deformed based on the weight of the spinal cord of the user. The harder protrusion provides a massaging effect to the spinal cord of the user.

The prior art described above teaches a variety of pillows, but does not teach a pillow having a horizontal top layer extending from a lengthwise roll portion and suspended over a hollow core so as to cradle the head of a user when lying on the pillow in the supine position and thereby provide gentle traction to the neck. Aspects of the present invention fulfill these needs and provide further related advantages as described in the following summary.

SUMMARY OF THE INVENTION

Aspects of the present invention teach certain benefits in construction and use which give rise to the exemplary advantages described below.

In an exemplary embodiment of the pillow apparatus of the present invention, the pillow comprises at least one roll portion, a bottom layer extending horizontally from the roll portion, a top layer extending horizontally from the roll portion substantially adjacent to the bottom layer, and a hollow core formed between the bottom layer and the top layer substantially centered within the pillow, such that a central back-sleeping region of the pillow is formed whereby the head and neck of a user arches back and tractions over the roll portion as supported by the top layer suspended over the hollow core when the user is in a supine position, and such that opposite side-sleeping regions of the pillow are formed adjacent the back-sleeping region whereby the head and neck of the user are maintained in a substantially straight posture as supported by the roll portion and the top and bottom layers when the user is in a side position.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

Figure 1:
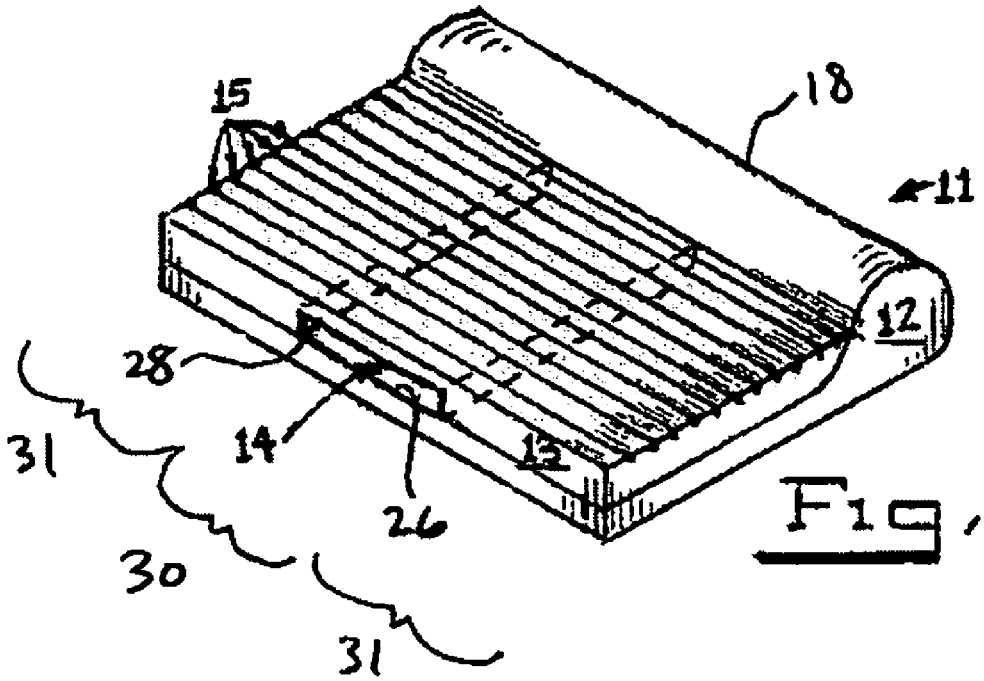
FIG. 1 is a perspective view of an exemplary embodiment of the invention.

The above-described drawing figures illustrate aspects of the invention in at least one of its exemplary embodiments, which aspects are further defined in detail in the following description.

In general, the present invention provides an orthopedic pillow having advantages over other such pillows known and used in the art. Past orthopedic pillows often have a peanut shape or other such configuration that for a majority of people is uncomfortable. While sleeping on one's side, such prior art pillows typically cause the neck to arch over excessively laterally, in turn creating pressure on the small joint in the cervical spine known as the uncinate processes. This can cause the user to awaken with neck pain and muscle spasms and may even lead to osteoarthritis of these joints over time. Also, while lying supine, the shape of such prior art pillows often causes a forward protrusion of the head that can create an anterior weight bearing posture in the user, shortening the anterior cervical spine musculature and increasing the curve in the thoracic and lumbar spine, thereby resulting in hyper-kyphosis or hyper-lordosis. Such poor posture over time can lead to a variety of musculoskeletal problems with such symptoms as headaches, neck and/or back pain, numbness or tingling in arms or hands, etc. The poor spinal positioning and resulting poor posture caused by many prior art pillows can also irritate pre-existing problems such as arthritis and disc syndromes. Since the average person spends approximately one third of his or her life in a sleeping position and during sleep the human body repairs, it is important to be in a biomechanical position that will accommodate and enhance this process. The pillow that is the subject of the present invention fulfills these needs and yields further advantages, as described below, by generally providing an ergonomic design having a central hollow core and opposite lateral side supports with a substantially cylindrical roll for supporting the neck, whereby the hollow core combined with the cylindrical roll allow for proper neutral curve (lordosis) and gentle traction of the user's cervical spine while in a supine position, while the combination of the resilient, non-hollow side sections with the resilient cylindrical front roll maintains a neutral spinal position even while side sleeping. While particular embodiments of the invention are shown and described, those skilled in the art will appreciate that variations on these exemplary embodiments are possible without departing from the spirit and scope of the invention.

The exemplary pillow of the present invention is generally made by forming or abutting resilient sections together so as to form a hollow core substantially at the pillow's lateral center. The bottom resilient section is typically rectangular in shape with a substantially cylindrical roll along the front aspect. The top section has rectangular side head supports on either end and a hollow section in between. This top section then has a relatively thin top layer bridging over the two resilient rectangular side head supports, thus creating a tunnel or the referred to hollow core. Depending on the construction, this hollow core may be completely enclosed or may be exposed at one or both ends. The thin top bridging layer may be formed with small longitudinal channel cuts for added comfort and traction. Again, by assembling such resilient pieces to create the pillow of the present invention, a hollow core in the center of the device is formed with a cylindrical roll in front of this core. Such structure allows the head to arch back over the cylindrical roll and be supported by the top layer suspended over the hollow core, enabling gentle axial traction of the cervical spine while in the supine position. Because the discs in the spine imbibe in nutrient fluid in order to maintain health to theses tissues during sleep, the gentle traction caused by the cradling of the head on the thin top layer substantially over the hollow core in combination with the neck being supported relatively more firmly by the cylindrical roll helps to create a relatively negative pressure within the disc space, which in turn enhances the imbibing mechanism and increases the flow of nutrients into the disc. While sleeping supine in the center of the pillow, one can easily roll to either side and onto the resilient rectangular side head supports and out of the hollow core. The instant design thus provides for the different heights required for multi-positional sleep and substantially maintains a neutral spine in all such sleep positions. Once more, those skilled in the art will appreciate that while particular shapes and configurations of the bottom, side, top and front sections of the pillow are shown and described, the invention is not so limited.

Figure 8:
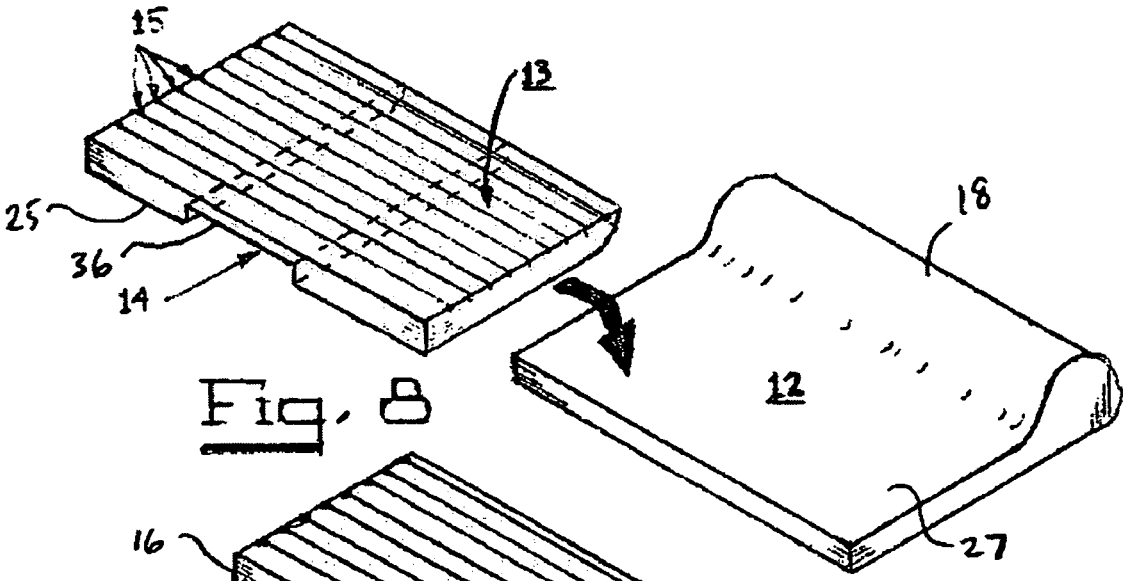
FIG. 8 is an exploded perspective view thereof.
Figure 9:
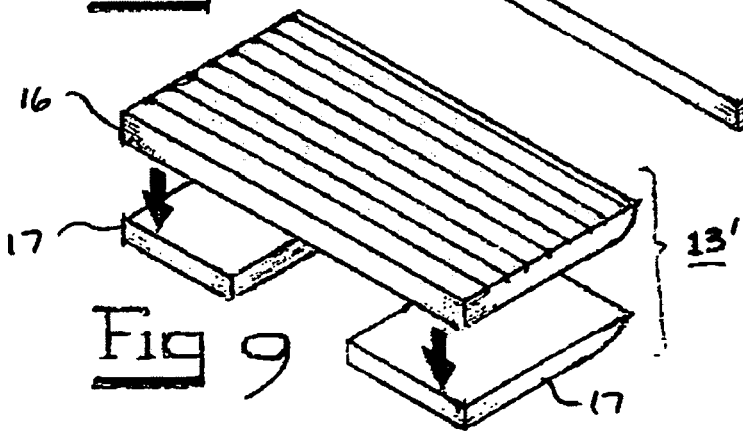
FIG. 9 is a partial exploded perspective view of an alternative exemplary embodiment of the invention.

Referring now to the drawings in detail, FIG. 1 shows a perspective view of the pillow generally designated with the numeral '11'. The pillow 11 generally comprises an assembly of resilient material of different shapes abutted together to form a unitary structure, namely, a bottom layer 12, an abutting top layer 13, and a lengthwise adjacent roll portion 18. In the first exemplary embodiment, the top layer 13 of the pillow 11 has a rectangular channel cut out on the underside. The top layer 13 can either be made of one piece as shown in FIG. 8 or three pieces assembled together as shown in FIG. 9, these three pieces comprising a top panel 16 and two opposite side panels 17, more about which is said below. Or, the rectangular cutout could just as easily be formed in the bottom layer 12 or through some combination of cutouts in both layers 12, 13. By abutting these resilient materials of different shapes with one or more such cutouts, this allows a hollow core (or traction core) 14 to be formed roughly in the center of the pillow 11. The hollow core 14 thus formed between the bottom layer 12 and the top layer 13 creates in the pillow 11 two distinct regions: a central back-sleeping region 30 whereby the head 51 and neck 52 of a user 50 arches back and tractions over the roll portion 18 as supported by the top layer 13 suspended over the hollow core 14 when the user is in a supine position, and such that opposite side-sleeping regions 31 of the pillow are formed adjacent the back-sleeping region 30 whereby the head 51 and neck 52 of the user 50 are maintained in a substantially straight posture as supported by the roll portion 18 and the top layer 13 and bottom layer 12 when the user is in a side position, as explained more fully below.

Figure 2:
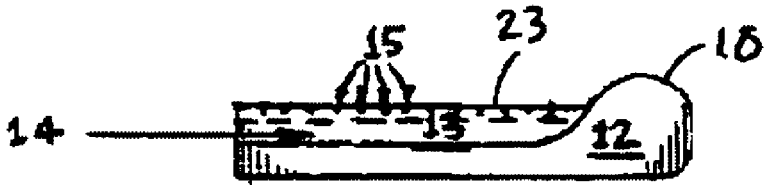
FIG. 2 is a side view thereof.
Figure 3:
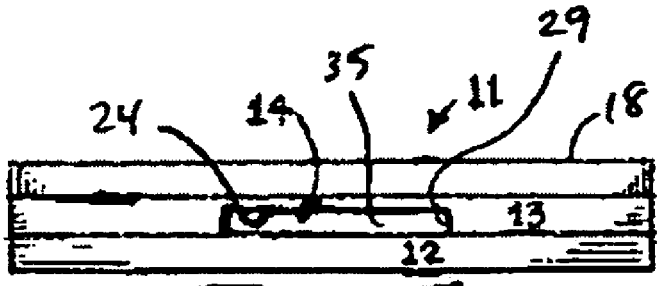
FIG. 3 is a rear view thereof.
Figure 5:
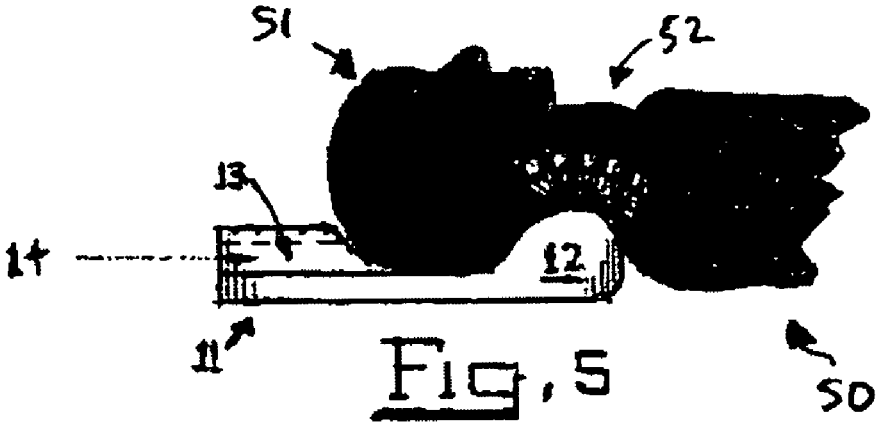
FIG. 5 is a side view thereof while in use in a first sleep position.
Figure 4:
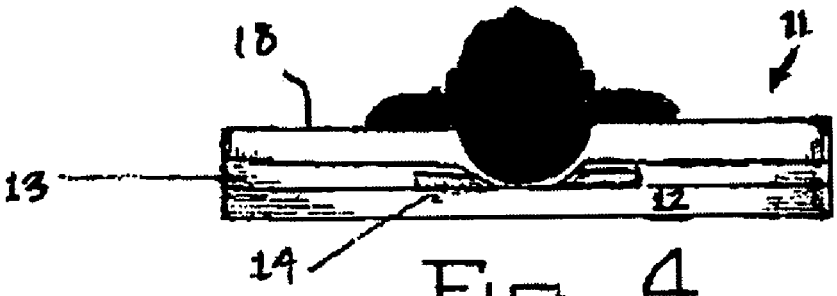
FIG. 4 is a rear view thereof while in use in a first sleep position.

FIG. 2 illustrates a side view of the first exemplary embodiment of the present invention depicting the top layer 13 and the bottom layer 12 abutted together and extending substantially horizontally from the roll portion 18 to form the pillow 11. FIG. 3 shows the rear view of the same exemplary pillow 11 illustrating the substantial centerline position of the hollow core 14. As can best be seen in both FIGS. 2 and 3, in the preferred embodiment, the front cylindrical roll 18 is formed integral with the lower layer 12 such that its highest aspect is vertically higher than the top side 23 of the top layer 13 when the layers 12, 13 are abutted together. In the exemplary embodiment, the top side 23 is further configured with longitudinal, spaced-apart channels 15 for added comfort and traction. While a particular size ratio of the respective layers 12, 13 to the roll 18 and of the channels 15 to the top layer 13 is illustrated, those skilled in the art will appreciate that numerous such configurations are possible without departing from the spirit and scope of the invention and, accordingly, that the invention is not so limited.

With continued reference to FIG. 1, with regard to the hollow core 14, it will be appreciated that the core is formed effectively by the structure of the surrounding bottom and top layers 12, 13 and the at least one roll portion 18. First, the substantially horizontal top core surface 24 is formed from an exposed portion of the lower side 25 of the top layer 13. Similarly, the substantially horizontal bottom core surface 26 opposite of and spaced apart from the top core surface 24 is formed from an exposed portion of the upper side 27 of the bottom layer 12. The left core surface 28 and an opposite and spaced apart right core surface 29 connect the top core surface 24 and the bottom core surface 26 in respective first and second planes that, in the exemplary embodiment, are substantially vertical and parallel to one another, or substantially perpendicular to the top and bottom core surfaces 24, 26. Finally, in the exemplary embodiment of FIGS. 1–3, an end core surface 35 connecting the top core surface 24, the bottom core surface 26, the left core surface 28, and the right core surface 29 is defined by essentially the back side of the roll portion 14.

Turning now to the exploded or assembly view of the first exemplary embodiment of the present invention shown in FIG. 8, it will again be appreciated that the front roll portion 18 may be formed integral with the bottom layer 12. The second component of the pillow 11 would then be the top layer 13, in the exemplary embodiment with the rectangular cutout 36 formed in the lower side 25 thereof so as to form the hollow core 14 when the top layer 13 is assembled onto the bottom layer 12. Or, in the alternative, again, the bottom layer 12 may be formed on its upper side 27 with an upwardly-opening rectangular cut-out (not shown) to achieve the same result when the top and bottom layers 12, 13 are assembled. In any case, the front edge of the top layer 13 is preferably formed with a curvature matching that of the back side of the roll portion 18, and the overall length and width of the top layer 13 is configured to substantially correspond to the relevant profile of the bottom layer 12 so as to achieve a uniform construction and appearance of the pillow 11 when assembled, as best shown in FIG. 1. The materials of the bottom and top layers 12, 13 and roll portion 18 may be selected from any now known or later developed foams, whether synthetic or natural, though the preferred foam is a polyurethane foam. In an exemplary embodiment, the integral bottom layer 12 and roll portion 18 may be formed of a first, relatively firmer foam to provide structural support to the pillow 11 and adequate support under the neck, whether back or side sleeping, while the top layer 13 may be formed of a relatively softer foam for gentle and flexible support of the head and softness to the face, particularly when side sleeping. If two or more components are to be assembled to form the finished pillow as in the exemplary embodiment, such assembly may be through any bonding or other means now known or later developed. Or, the two or more components may remain separate and temporarily secured in position relative to one another, as by Velcro® or other such non-permanent securing means, or may simply be held in position by the outer, removable pillow case (not shown). In this way, it will be appreciated that the bottom or top layers 12, 13 may be replaceable, as in the event that one of the layers wears out or the user simply would like to adjust the pillow's firmness by substituting one or more layers formed of foams of different qualities. In that same regard, though two components are shown, with the bottom layer 12 extending from the front roll portion 18 to form the bottom sub-component, those skilled in the art will appreciate that the bottom layer 12 need not be integral with the front roll portion 18, such that the pillow may be permanently or temporarily formed of three components, in the latter case any or all of the three components being replaceable. In a further alternative exemplary embodiment, the pillow may be formed from a single piece of foam with a central hole formed vertically therethrough so as to define the roll portions and side sleeping portions effectively about the four sides of the hole. Then, a batting material or the like would simply be wrapped around the foam body of the pillow to effectively form the bottom and top layers and the hollow core in the center of the pillow. In such an embodiment, the foam body could be made of a single, unitary construction as described, or could be formed of two or more components, again, of potentially varying foam densities and either permanently or temporarily assembled together. The outer batting or wrap could also be replaceable for various reasons ranging from wear to user preference. Again, these various embodiments are to be understood as merely exemplary and that the invention is not so limited. Moreover, it is to be understood that while the exemplary and alternative embodiments of the pillow are shown and described as being constructed of multiple components, this is not necessary. Rather, it will be appreciated by those skilled in the art that such a pillow configuration may also be formed as through a molding process as a single, unitary structure as well. Accordingly, while the invention is referred to throughout as involving certain discrete layers and components, it is to be expressly understood that such functional and structural features need not be separate, but may instead be identifiable portions of a unitary whole. As a further exemplary embodiment of the pillow 11 of the present invention involving multiple components, attention is now directed to FIG. 9 showing the top layer 13' as a subassembly of three components: left and right, spaced-apart side panels 17 assembled to a top panel 16. In essence, then, when the bottom and top layers 12, 13 are then assembled, the side panels 17 are positioned between the layers so as to form the hollow core 14 therebetween. Such an alternative construction and assembly process may have advantages in manufacturing, again, as could a unitary construction or any other such construction that results in a pillow according to the present invention. Thus, once more, the present invention is not limited to any particular construction, and the various embodiments presented are to be understood as being merely exemplary.

Figure 6:
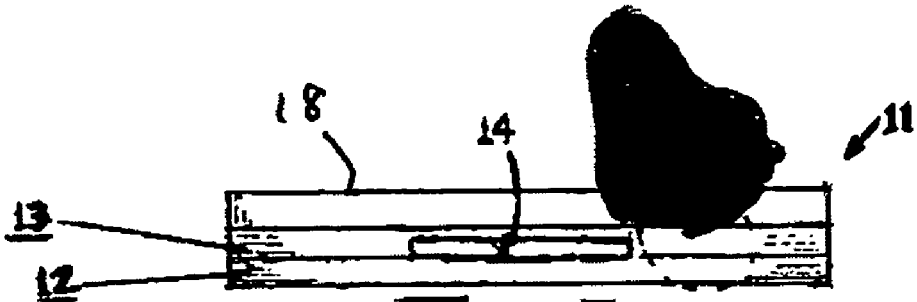
FIG. 6 is a rear view thereof while in use in a second sleep position.
Figure 7:
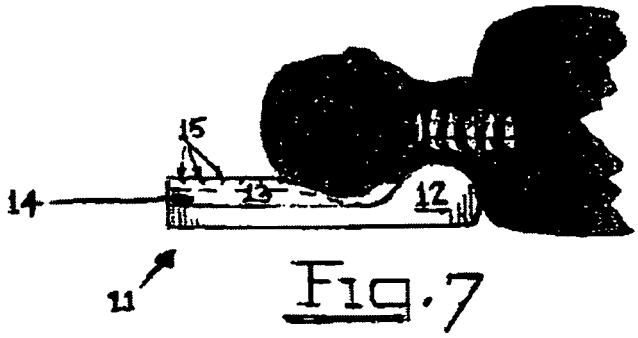
FIG. 7 is a side view thereof while in use in a second sleep position.

Referring now to FIGS. 4–7, in use, as illustrated in connection with the exemplary embodiment of the pillow 11 of the present invention depicted in FIGS. 1–3, those skilled in the art will appreciate that the roll portion 18 in cooperation with the top layer 13 suspended over the hollow core 14 allows the head 52 of a user 50 to arch back and gently traction over the cylindrical roll 18 while lying in a supine position substantially in the center of the pillow, or on the back-sleeping portion 30 (FIG. 1). Then, if the user 50 rolled to either side from the supine position, as illustrated in FIGS. 6 and 7, the top layer 13 directly abutting the bottom layer 12 below results in a non-hollow and rectangular, relatively more firm side-sleeping portion 31 (FIG. 1), bringing the neck 51 into a neutral side sleeping position as best seen in FIG. 7. Thus, the cylindrical roll portion 18 tucks into the nape of the neck, supporting the neck 51 in a relatively straight posture. FIG. 6 shows a rear view of a side-sleeping user 50 illustrating the non-hollow, resilient, rectangular side panels of the top layer 13 holding the head in a non-laterally-flexed position.

Figure 10:
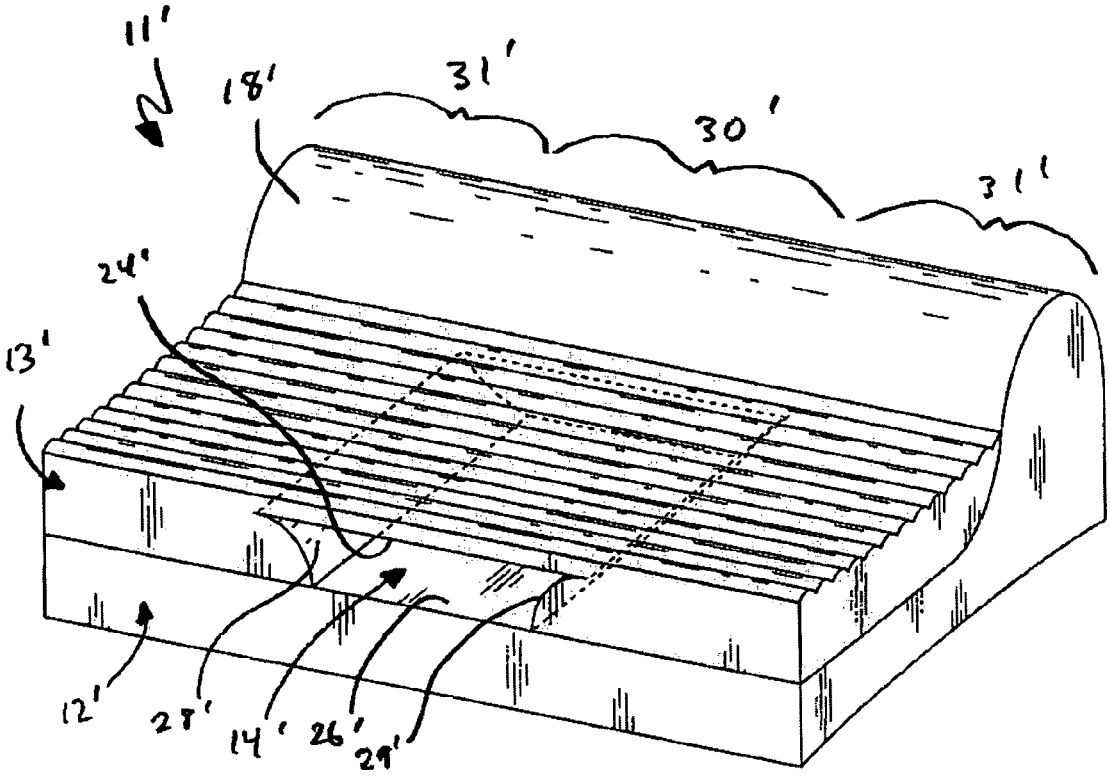
FIG. 10 is a perspective view of a further alternative exemplary embodiment of the invention.
Figure 11:
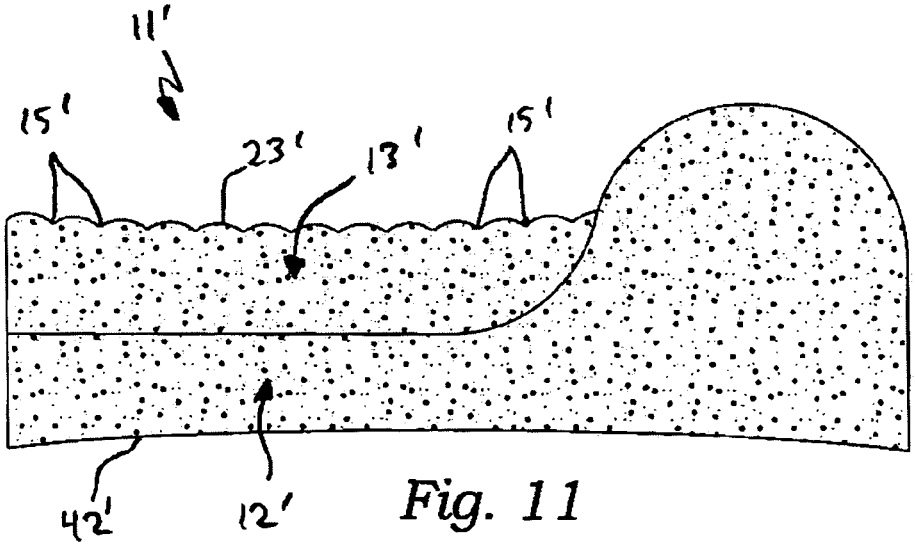
FIG. 11 is a side view thereof.

Turning now to FIGS. 10 and 11, there is shown an alternative exemplary embodiment of the present invention. The alternative pillow 11' again generally comprises at least one roll portion 18', a bottom layer 12' extending horizontally from the roll portion, and a top layer 13' extending horizontally from the roll portion substantially adjacent to the bottom layer. The top layer 13' again includes a rectangular cutout so as to form the hollow core 14' when the bottom and top layers 12', 13' are assembled together as shown. Here, though, in the alternative embodiment, the left and right core surfaces 28', 29' are effectively formed in planes that are at oblique angles to the top and bottom core surfaces 24', 26', rather than being perpendicular to those surfaces, or parallel to each other. Moreover, the left and right core surfaces 28', 29' are further formed with a longitudinally convex curvature. It will be appreciated that such curvature in cooperation with the oblique angles of the left and right core surfaces 28', 29' facilitates smooth transition of the head 51 of the user 50 from the back-sleeping region 30' of the pillow 11' to either side-sleeping region 31'. While a particular angle and curvature of the left and right core surfaces 28', 29' is illustrated, it will be appreciated by those skilled in the art that other such geometries are possible without departing from the spirit and scope of the invention. As best shown in FIG. 11, the pillow 11' may also be formed such that the bottom side 42' of the bottom layer 12' has a longitudinally concave curvature, which aids in the flexing and support of the pillow under different loads or sleep positions. While this concave curvature is shown as extending over substantially the entire bottom surface 42', those skilled in the art will appreciate that such curvature may be only over a portion of the bottom surface, as, for example, from the edge of the bottom layer opposite the roll portion 18' to a location along the bottom layer substantially corresponding to the edge of the top layer 13' closest to the roll portion, whereby the gentle flexing of the pillow would occur substantially underneath the head region of the pillow only and not under the neck region (i.e., the roll portion 18'). Accordingly, it will be appreciated that numerous configurations of the concave curvature, both in location and in radius of curvature, may be employed in addition to the exemplary embodiments shown and described without departing from the spirit and scope of the invention. Similarly, the top layer 13' may be formed such that its top side 23' also has a longitudinally concave curvature, which, again, may be of various configurations within the scope of the invention. As in the exemplary embodiment of FIGS. 1–3, the top side 23' may be further formed with longitudinal, spaced-apart channels 15' therealong.

Figure 12:
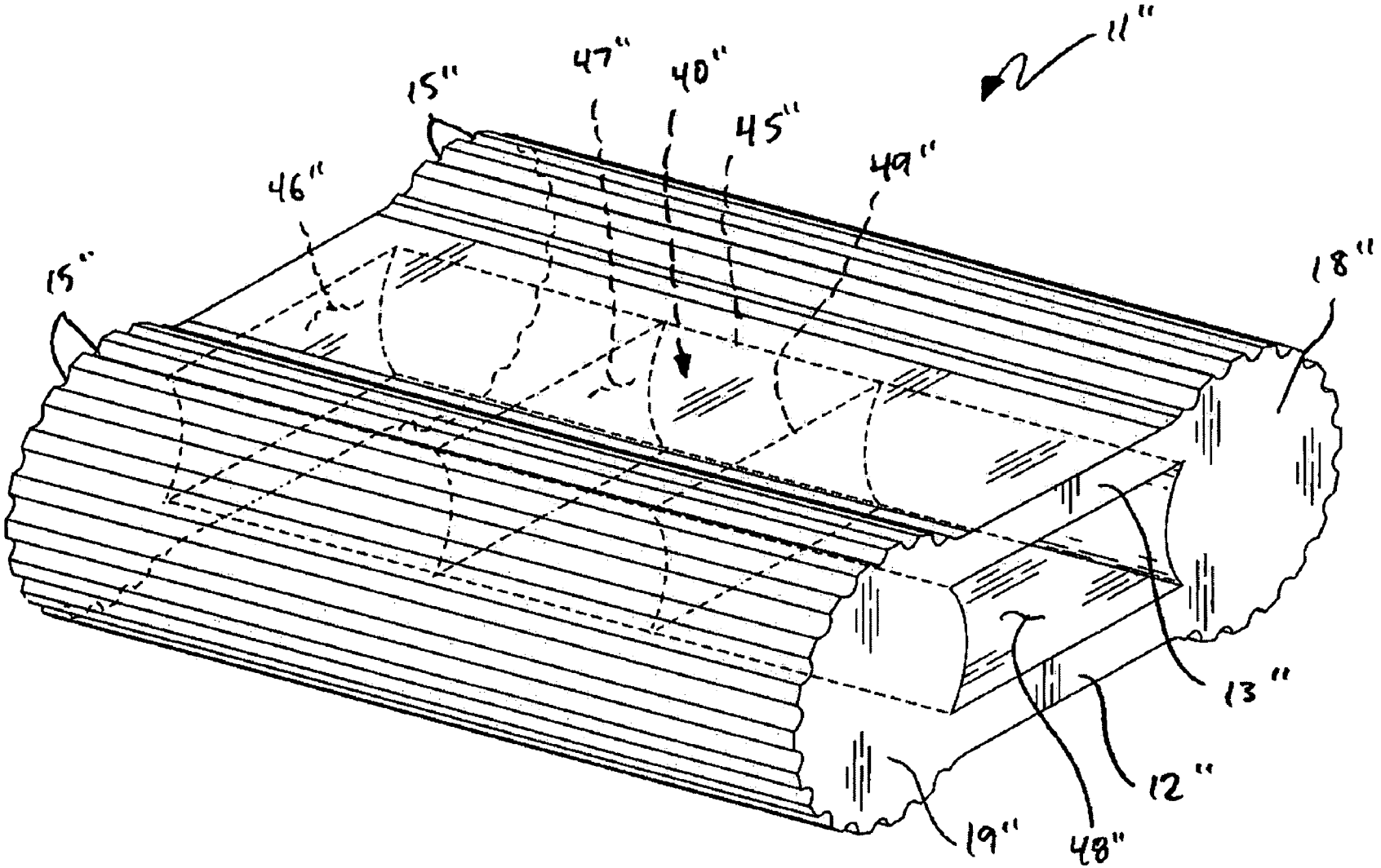
FIG. 12 is a perspective view of a further alternative exemplary embodiment of the invention.

Referring now to FIG. 12, there is shown a perspective view of yet another exemplary embodiment of the present invention. Here, the pillow 11" comprises a first roll portion 18" and an opposite, spaced-apart second roll portion 19" with the horizontal, adjacent bottom and top layers 12", 13" extending therebetween. A longitudinal core 45" is formed substantially centrally within the pillow 11" between the first and second roll portion 18", 19" and the bottom layer and top layer 12", 13", whereby opposite ends of the longitudinal core 45" are accessible. A first side-sleeping form 46" having a profile substantially conforming to the longitudinal core 45" is inserted within the longitudinal core from a first end so as to define a first inwardly-facing surface 47". Similarly, a second side-sleeping form 48" also having a profile substantially conforming to the longitudinal core 45" is inserted within the longitudinal core from a second end so as to define a second inwardly-facing surface 49". As such, in the alternative embodiment of FIG. 12, the hollow core 40" is defined within the longitudinal core 45" by surfaces comprising: a substantially horizontal top core surface formed from the exposed portion of the lower side of the top layer 13" between the first side-sleeping form 46" and the second side-sleeping form 48"; a bottom core surface opposite of and substantially parallel to the top core surface, the bottom core surface formed from the exposed portion of the upper side of the bottom layer 12" between the first and second side-sleeping forms 46", 48"; a left core surface defined by the first inwardly-facing surface 47" of the first side-sleeping form 46"; a right core surface opposite of and spaced apart from the left core surface, the right core surface comprised of the second inwardly-facing surface 49" of the second side-sleeping form 48"; a first end core surface formed from the exposed portion of the inner surface of the first roll portion 18" between the first side-sleeping form 46"

and the second side-sleeping form 48"; and a second end core surface formed from the exposed portion of the inner surface of the second roll portion 19" between the first and second side-sleeping forms 46", 48". As above in connection with FIGS. 1 and 10, the first and second inwardly-facing surfaces 47", 49" may be substantially parallel to one another or at any oblique angles relative to one another. The first and second roll portions 18", 19" may be further formed on their respective outer surfaces with longitudinal, spaced-apart channels 15" to again facilitate comfort and traction for the user. As with the other exemplary embodiments of the present invention, those skilled in the art will appreciate that the alternative embodiment of FIG. 12 is merely exemplary and that other such structure of the pillow of the present invention is possible without departing from its spirit and scope. Specifically, while a particular configuration of the double roll pillow is shown and described, the invention is not so limited to the structure and features disclosed in connection with the shape, relative size, or configuration of the channels of the roll portions, whether such channels are even included at all, and in connection with the first and second side-sleeping forms. That is, the shape of the pillow body defined by the first and second roll portions, the top and bottom layers, and the longitudinal extrusion may vary without departing from the spirit and scope of the invention. With regard to the side-sleeping forms, it will be further appreciated that such forms may be formed of the same material as the rest of the pillow or by some other material found useful in a particular application, as in the case where a different resiliency of the side-sleeping regions of the pillow is desired. Moreover, it may be possible in the present invention to make the side-sleeping portions conveniently removable rather than permanently assembled within the hollow core so as to selectively modify the resiliency of the pillow to suit a particular user's preferences or body type, or simply for replacement due to wear. Also, the pillow body itself consisting of the first and second roll portions 18", 19" and the bottom and top layers 12", 13", though described as being of a unitary construction in connection with the exemplary embodiment of FIG. 12, is not necessarily so. Instead, as above for the other exemplary embodiments of the present invention, may also be formed of two or more components, as in the case where it is desirable to form the roll portions of relatively stiffer or denser foam than the top and bottom layers. Again, such multiple components may be permanently or temporarily assembled without departing from the spirit and scope of the invention. Thus, again, those skilled in the art will appreciate that the present invention is not limited to any particular configuration, but may readily be adapted to suit different contexts.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A pillow apparatus comprising:

at least one roll portion;

a bottom layer extending horizontally from the roll portion;

a top layer extending horizontally from the roll portion substantially adjacent to the bottom layer; and a hollow core formed between the bottom layer and the top layer substantially centered within the pillow, such that a central back-sleeping region of the pillow is formed whereby the head and neck of a user arches back over the roll portion as supported by the top layer suspended over the hollow core when the user is in a supine position, and such that opposite side-sleeping regions of the pillow are formed adjacent the back-sleeping region whereby the head and neck of the user are maintained in a substantially straight posture as supported by the roll portion and the top and bottom layers when the user is in a side position.

2. The apparatus of claim 1 wherein:

the top layer is formed with a lower side; and a rectangular cutout is formed in the lower side of the top layer so as to form the hollow core.

3. The apparatus of claim 1 wherein:

the bottom layer is formed with an upper side; and a rectangular cutout is formed in the upper side of the bottom layer so as to form the hollow core.

4. The apparatus of claim 1 wherein left and right, spaced-apart side panels are positioned between the top layer and the bottom layer so as to form the hollow core.

5. The apparatus of claim 1 wherein:

the top layer is formed with a top side; and longitudinal, spaced-apart channels are formed along the top side of the top layer.

6. The apparatus of claim 1 wherein:

the bottom layer is formed with a bottom side; and the bottom side of the bottom layer is formed with a longitudinally concave curvature along a portion thereof.

7. The apparatus of claim 1 wherein:

the top layer is formed with a top side; and the top side of the top layer is formed with a longitudinally concave curvature along a portion thereof.

8. The apparatus of claim 1 wherein:

the top layer is formed with a top side; and longitudinal, spaced-apart channels are formed along the top side of the top layer.

9. The apparatus of claim 1 wherein:

the top layer is formed with a lower side;

the bottom layer is formed with an upper side; and the hollow core is defined by surfaces comprising:

a substantially horizontal top core surface formed from an exposed portion of the lower side of the top layer;

a substantially horizontal bottom core surface opposite of and spaced apart from the top core surface, the bottom core surface formed from an exposed portion of the upper side of the bottom layer;

a left core surface connecting the top core surface and the bottom core surface in a first plane;

a right core surface opposite of and spaced apart from the left core surface, the right core surface connecting the top core surface and the bottom core surface in a second plane; and at least one end core surface connecting the top core surface, the bottom core surface, the left core surface, and the right core surface.

10. The apparatus of claim 9 wherein the first plane and the second plane are substantially vertical and substantially parallel.

11. The apparatus of claim 9 wherein the first plane and the second plane are at oblique angles to the top and bottom core surfaces.

12. The apparatus of claim 11 wherein the left and right core surfaces are formed with a longitudinally convex curvature.

13. The apparatus of claim 1 wherein the top layer is removably assembled to the bottom layer.

14. The apparatus of claim 1 wherein:

the pillow apparatus comprises two roll portions;

left and right, spaced-apart side panels are positioned between the roll portions so as to define the perimeter of the hollow core, whereby the at roll portions and the side panels are of a unitary construction; and the top layer and the bottom layer are formed from a single material wrapped about the roll portions and the side panels to form the hollow core.

15. The apparatus of claim 1 wherein:

the pillow comprises a first roll portion and an opposite, spaced-apart second roll portion, the first roll portion having a first outer surface and a first inner surface and the second roll portion having a second outer surface and a second inner surface;

the bottom layer extends horizontally between the first roll portion and the second roll portion and is formed with an upper side;

the top layer extends horizontally between the first roll portion and the second roll portion substantially adjacent to the bottom layer and is formed with a lower side;

a longitudinal core is formed substantially centrally within the pillow between the first roll portion and the second roll portion and between the bottom layer and the top layer;

a first side-sleeping form having a profile substantially conforming to the longitudinal core is inserted within the longitudinal core from a first end so as to define a first inwardly-facing surface;

a second side-sleeping form having a profile substantially conforming to the longitudinal core is inserted within the longitudinal core from a second end so as to define a second inwardly-facing surface; and the hollow core is defined within the longitudinal core by surfaces comprising:

a substantially horizontal top core surface formed from the exposed portion of the lower side of the top layer between the first side-sleeping form and the second side-sleeping form;

a bottom core surface opposite of and substantially parallel to the top core surface, the bottom core surface formed from the exposed portion of the upper side of the bottom layer between the first side-sleeping form and the second side-sleeping form;

a left core surface defined by the first inwardly-facing surface of the first side-sleeping form inserted within the core from the first end;

a right core surface opposite of and spaced apart from the left core surface, the right core surface comprised of the second inwardly-facing surface of the second side-sleeping form inserted within the core from the second end;

a first end core surface formed from the exposed portion of the first inner surface of the first roll portion between the first side-sleeping form and the second side-sleeping form; and a second end core surface formed from the exposed portion of the second inner surface of the second roll portion between the first side-sleeping form and the second side-sleeping form.

16. The apparatus of claim 15 wherein longitudinal, spaced-apart channels are formed along the first outer surface of the first roll portion and along the second outer surface of the second roll portion.

17. A pillow apparatus comprising:

at least one roll portion;

a bottom layer extending horizontally from the roll portion, the bottom layer being formed with a bottom side and an upper side, the bottom side of the bottom layer being formed with a longitudinally concave curvature;

a top layer extending horizontally from the roll portion substantially adjacent to the bottom layer, the top layer being formed with a top side and a lower side; and a hollow core formed between the bottom layer and the top layer substantially centered within the pillow, the hollow core being defined by surfaces comprising:

a substantially horizontal top core surface formed from an exposed portion of the lower side of the top layer;

a substantially horizontal bottom core surface opposite of and spaced apart from the top core surface, the bottom core surface formed from an exposed portion of the upper side of the bottom layer;

a left core surface connecting the top core surface and the bottom core surface in a first plane;

a right core surface opposite of and spaced apart from the left core surface, the right core surface connecting the top core surface and the bottom core surface in a second plane; and at least one end core surface connecting the top core surface, the bottom core surface, the left core surface, and the right core surface; whereby:

a central back-sleeping region of the pillow is formed such that the head and neck of a user arches back and tractions over the roll portion as supported by the top layer suspended over the hollow core when the user is in a supine position; and opposite side-sleeping regions of the pillow are formed adjacent the back-sleeping region such that the head and neck of the user are maintained in a substantially straight posture as supported by the roll portion and the top and bottom layers when the user is in a side position.

18. A method of providing traction to and alignment of the neck of a user while sleeping, comprising the steps of:

positioning the user in a first position defined by the user lying supine substantially along the lateral centerline of a pillow;

supporting the neck of the user with a roll portion formed along a lengthwise edge of the pillow substantially perpendicular to the lateral centerline of the pillow; and supporting the head of the user while positioned in the first position on a top layer of the pillow extending substantially horizontally from the roll portion and suspended over a hollow core formed substantially centrally within the pillow.

19. The method of claim 18, comprising the further steps of:

positioning the user in a second position defined by the user lying on a side of the user substantially along a line offset from the lateral centerline of the pillow; and supporting the head of the user while positioned in the second position on a portion of the top layer of the pillow installed on a bottom layer substantially adjacent to the top layer.

20. The method of claim 18, comprising the further step of replacing the top layer of the pillow to adjust the resiliency of the pillow.

21. The method of claim 18, comprising the further step of selectively inserting side-sleeping forms within a longitudinal core formed in the pillow so as to define the hollow core and adjust the resiliency of the pillow.

* * * * *